United States Patent [19]

Taylor et al.

[11] 4,363,359

[45] Dec. 14, 1982

[54] LOCKING ASSEMBLY FOR WELL DEVICES

[75] Inventors: Donald F. Taylor; William G. Boyle, both of Dallas, Tex.

[73] Assignee: Otis Engineering Corporation, Dallas, Tex.

[21] Appl. No.: 199,034

[22] Filed: Oct. 20, 1980

[51] Int. Cl.[3] ..... E21B 23/02

[52] U.S. Cl. ..... 166/214; 166/216; 166/126; 417/360

[58] Field of Search ..... 166/214, 210, 217, 136, 166/138, 126; 417/501, 360

[56] References Cited

U.S. PATENT DOCUMENTS

| | | | |
|---|---|---|---|
| 3,096,824 | 7/1963 | Brown | 166/138 |
| 3,128,826 | 4/1964 | Brown | 166/138 |
| 3,593,784 | 7/1971 | Brown | 166/217 |
| 3,853,430 | 12/1974 | O'Rourke | 166/217 |
| 4,121,659 | 10/1978 | Taylor | 166/217 |
| 4,171,934 | 10/1979 | Zehren | 417/360 |
| 4,276,932 | 7/1981 | Saliger et al. | 166/217 |
| 4,286,663 | 9/1981 | Miffre | 166/217 |

*Primary Examiner*—James A. Leppink

*Attorney, Agent, or Firm*—Vinson & Elkins

[57] ABSTRACT

A locking assembly for well devices, such as a cable suspended electric pump, for anchoring the device against both axial and rotative movement within a well flow conductor. The assembly includes locking keys engageable with locking recesses provided in the flow conductor to support the device within said conductor. An expander mandrel actuated by the torque forces developed by a rotating element of the well device coacts with said locking keys to urge said keys into tighter locking position and thereby prevent rotation of said assembly within the flow conductor. The assembly also includes an equalizing valve which equalizes pressures across the assembly and the well device prior to releasing the locking action of the locking keys.

13 Claims, 12 Drawing Figures

Fig. 5
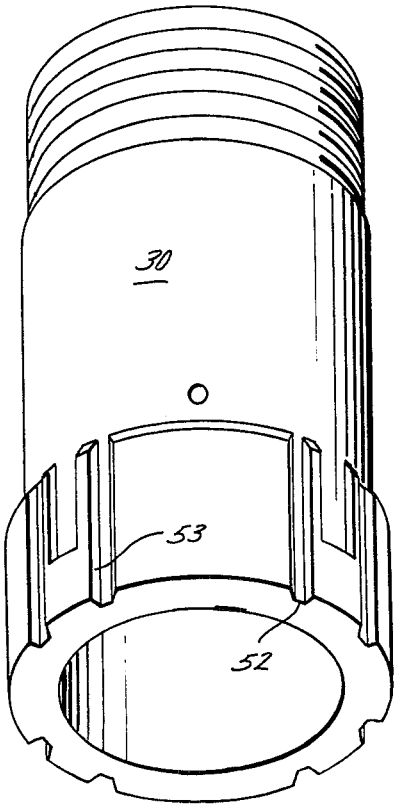
Fig. 1
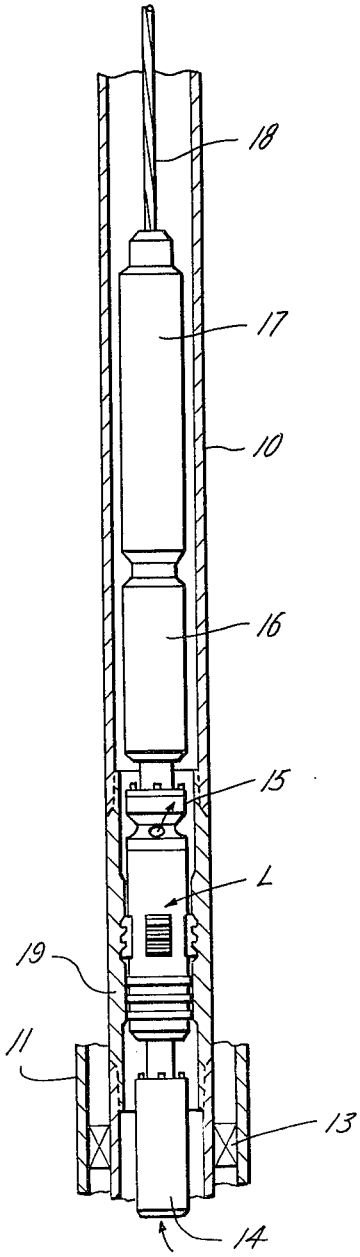
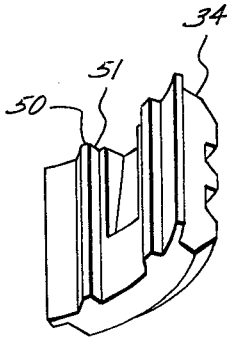
Fig. 6

LOCKING ASSEMBLY FOR WELL DEVICES

This invention relates to new and useful improvements in Locking Assemblies for Well Devices and is particularly adapted for use in locking cable suspended submergible electric pumping equipment in operating position within a well tubing.

BACKGROUND OF THE INVENTION

In the production of fluids from wells, it is a common practice to utilize submergible pumping equipment to bring well liquids to the surface at a desired rate and one type of pumping unit now in use is the submergible pump which is lowered into the well beneath the surface of the liquid and which is powered by an electric motor. The pump and motor are lowered and removed from the well by a suspension cable having both weight supporting and electrical power conducting capabilities. After the pumping unit and motor are properly located within the well, it is necessary that the assembly be locked or anchored in such location to prevent displacement thereof during the pumping operation. Not only is the pumping equipment and its locking assembly subjected to the pressure forces tending to displace the same from the well in an axial or longitudinal direction but because the pump is driven by the rotating shaft of the electric motor, said equipment and its locking assembly is also subjected to the torque or rotative forces developed and transmitted thereto by said rotating motor shaft. This torque force tends to rotate the locking assembly and pumping equipment which may result in damage to these elements.

Various locking assemblies for submergible pumping equipment have been in use and although such prior assemblies usually provide adequate locking against axial or longitudinal displacement, none of said prior assemblies include a simple and practical positive means for locking or anchoring the equipment against rotative movement. Examples of prior attempts to effect locking against rotative movement are disclosed in the U.S. Pat. Nos. 4,121,659 to Taylor and 4,171,934 to Zehren. The Taylor patent recognizes that rotation of the assembly should be prevented but relies on the frictional grip of sealing members to "resist rotation" of said assembly by the pump. Obviously, such frictional contact of resilient sealing material is insufficient to assure that the assembly will not rotate under the torque forces. The Zehren patent also recognizes the need for preventing rotation of the locking assembly and provides a lock for preventing rotation of the discharge head by means of a complex arrangement which expands locking lugs into recesses; also the outer member of the discharge head has a second lock comprising interengaged teeth elements. Once engaged, the locking lugs cannot be released without removing the entire pumping unit and removal can be accomplished through the shearing of pins. Other prior patents, such as the U.S. Pat. No. to O'-Rourke, 3,853,430 illustrate locking assemblies but suggest no simple solution to preventing rotation due to torque forces.

OBJECTS OF THE INVENTION

It is therefore a principal object of this invention to provide an improved locking assembly for efficiently locking pumping equipment within a well conductor to prevent axial and rotative displacement of said equipment when said pumping equipment is in operation.

An important object is to provide an improved locking assembly for well pumps which utilizes the torque forces, both starting inertia torque and running torque, developed by the rotating motor shaft of the pumping equipment to lock or anchor the assembly and equipment against rotative movement of these parts when the pump is operating.

A further object is to provide the locking assembly for submergible pumping equipment which includes a pressure equalizing valve for equalizing the pressures across the assembly and equipment prior to releasing the lock of said assembly, whereby any danger of well pressures forcibly blowing the equipment out of the well or holding the assembly in its landed position is eliminated.

A particular object is to provide a locking assembly which includes radially movable locking keys or dogs which are engageable with locking recesses to lock the assembly within a well conductor; said assembly also having an internal expander mandrel coacting with said locking keys to urge the same into friction gripping position within the recesses, with said expander sleeve being actuated by the torque forces developed by the rotating motor shaft of the pumping equipment.

Another object is to provide a locking assembly of the character described which converts the torque forces developed by a rotating element into a radial force whereby such radial force may be efficiently applied to radially movable locking elements to more firmly set said elements in locking position.

BRIEF DESCRIPTION OF THE DRAWINGS

Other objects and advantages of the present invention are hereinafter set forth and are explained in detail with reference to the drawings wherein:

FIG. 1 is a view partly in cross-section and partly in elevation showing the locking assembly of this invention locking a pump in a well tubing suspended in a well casing;

FIGS. 5 and 6 are isometric views showing the expander mandrel and a locking key showing the relationship of these parts while the locking assembly is being run in the tubing.

DESCRIPTION OF THE PREFERRED EMBODIMENTS

Figure 2A:
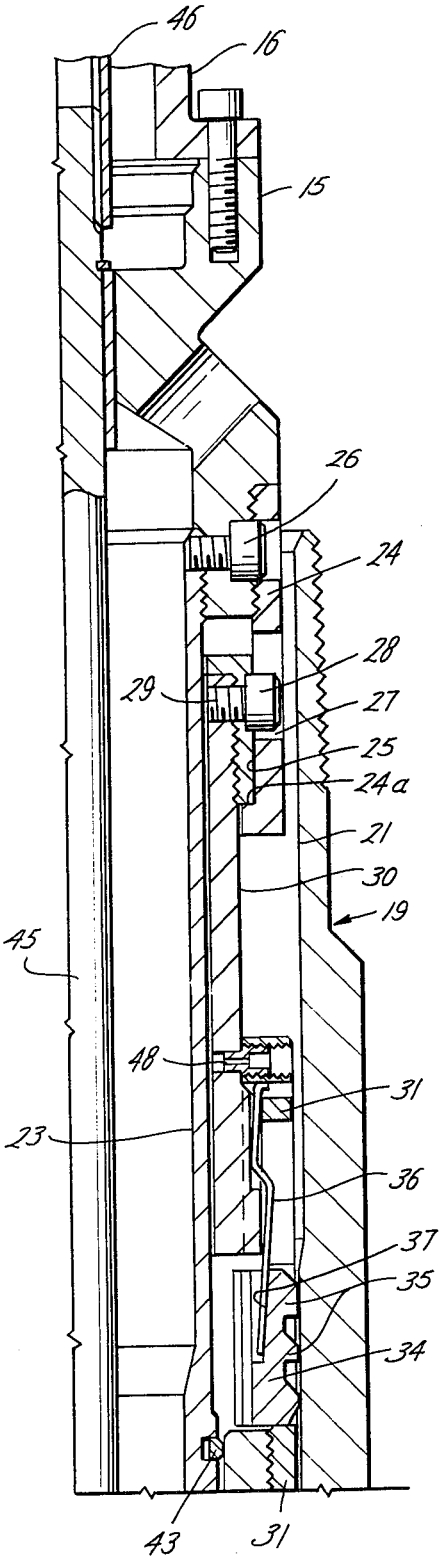
FIGS. 2A and 2B are continuation views partly in section and partly in elevation showing the locking assembly being run into a landing nipple.
Figure 2B:
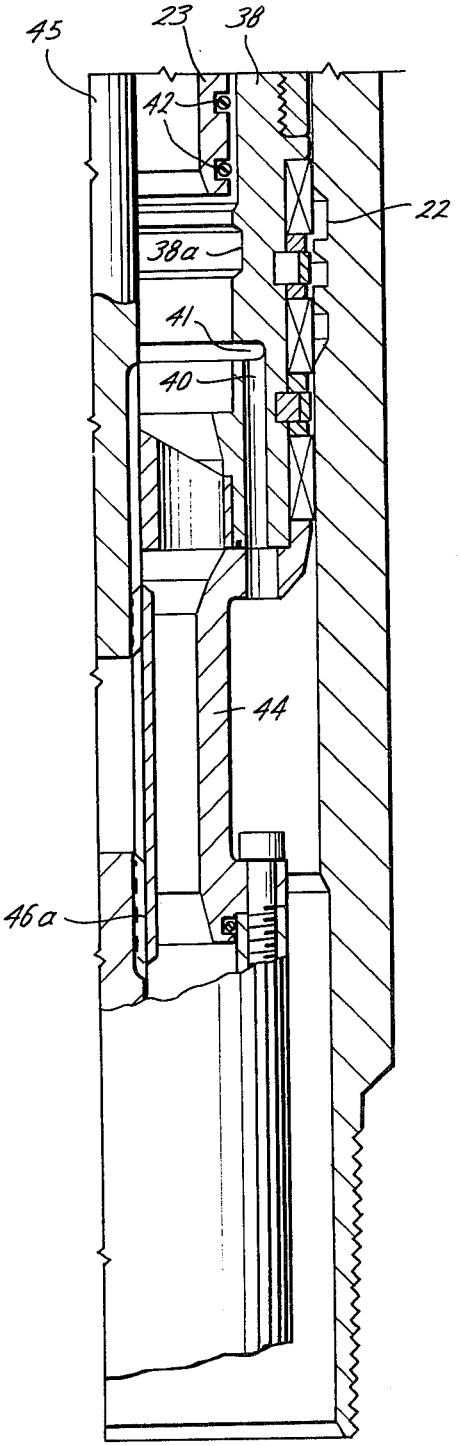
Figure 3A:
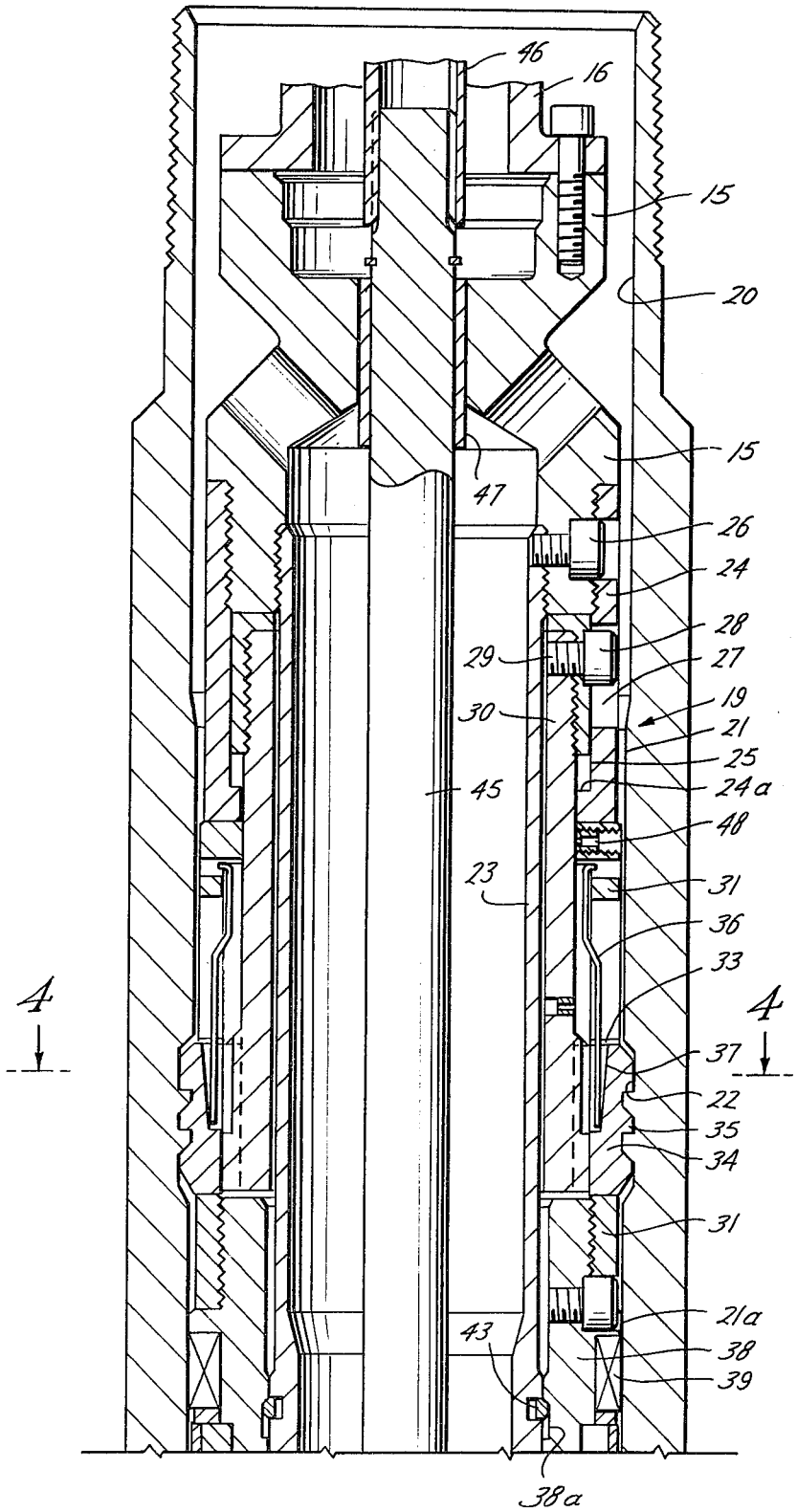
FIGS. 3A and 3B are continuation views partly in section and partly in elevation showing the locking assembly installed in a landing nipple.
Figure 3B:
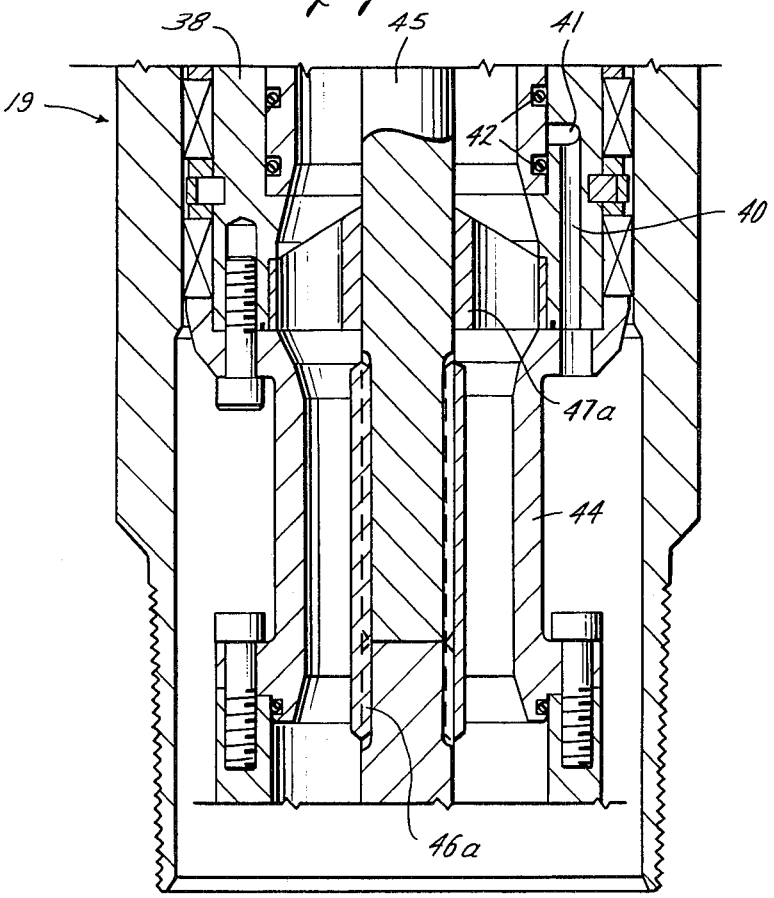

In FIG. 1 of the drawings, a submergible pump installation which is adapted to be anchored or locked within a well conductor by the improved locking assembly L is illustrated. The particular well conductor shown is the usual tubing 10 which extends downwardly within the well casing 11 and the annulus between said tubing and casing is sealed by a suitable packer 13, whereby the well fluids will flow upwardly into said tubing. Although a submergible pump installation is illustrated, it will be understood that other equipment may be anchored or locked within a well conductor by means of the novel locking assembly L.

The pump installation which is schematically shown in FIG. 1 includes an electric pump 14 which is disposed at the lower end of the installation when the equipment is positioned within the well. The pump communicates with a discharge head 15 having connection with a motor protector 16 which, in turn, has connection with the electric motor 17. The pumping equipment is lowered into place by means of a cable 18 secured to the upper end of the motor 17 and said cable is a suspension cable which has both weight supporting and electrical power conducting capabilities.

For mounting the pump, motor and associated parts within the tubing, a pump shoe or landing nipple 19 is connected in the tubing string and is adapted to receive the locking assembly L. The assembly L, as will be described, lands and locks within the shoe and both suspends and seals the pump in position. The particular submergible pump and related equipment are all units which are available on the market and are distributed by the REDA Pump Division of TRW, Bartlesville, Oklahoma. The locking assembly provides an improved arrangement for landing and locking equipment within a well conductor and is shown in detail in FIGS. 2A–B and 3A–B.

The upper end of the landing nipple 19 is threaded into a joint of the well tubing and has a bore 20 extending entirely therethrough. The intermediate area of the bore 20 is reduced in diameter as indicated at 21 and at the lower portion of this reduced area, a profile of annular grooves 22 are formed. The grooves 22 constitute a patterned set of annular recesses which, as will be explained, provide the locking recesses which will retain the equipment in place within the well tubing. Below the locking recesses, the bore 20 has a smooth portion 21*a* of substantially constant diameter and this surface provides an area upon which sealing can be accomplished. The lower end of the landing nipple is connected to another section of the tubing string 10 and thus, said nipple forms a portion of the tubing string. If desired, a no-go shoulder may be provided in the nipple at the lower end of portion 21*a* to cooperate with the latch assembly and positively limit downward movement of the assembly as will be understood by those skilled in the art.

The locking assembly L has connection with the discharge head 15 which is bolted or otherwise secured to the lower end of the motor protector 16. An inner tubular support 23 has its upper end threaded to the lower inner bore of the discharge head and said support extends downwardly therefrom for a substantial distance. Also threaded onto the exterior lower portion of the discharge head 15 is a collar 24 having its bore spaced from the exterior surface of the tubular support to form an annular space 25 between the members 23 and 24. The collar 24 has an inwardly directed flange 24*a* at its lower end and its upper end is further secured to the discharge head by means of a cap screw 26 which also extends through the upper end of the tubular support 23 to securely fasten the support and collar to the discharge head.

The upper portion of the collar 24 is formed with a slot 27 within which the head 28 of a second cap screw 29 extends to define the sliding limit of the screw. Cap screw 29 is threaded into the upper end of an expander member or mandrel 30. The upper end portion of mandrel 30 is slidable in the annular space 25 formed between the inner tubular support 23 and the collar 24 and is connected to the support through the cap screw 29 and slot 27. By reason of this connection, the expander mandrel may undergo movement, as determined by the length of the slot 27, with respect to the inner tubular support.

An outer sleeve or tubular body 31 surrounds both the expander mandrel and the tubular support and is mounted to slide with respect to both the expander mandrel and the inner tubular support. A plurality of windows 33 which extend entirely through the wall of said sleeve are cut in the wall of the sleeve or body and mounted to move radially within each window is an arcuate locking key or dog 34 having external projections 35 formed thereon. A spring 36 having its upper end retained within the upper portion of the sleeve has its lower end engaging a recess 37 in the inner surface of the locking key and said spring exerts its pressure to constantly urge the locking key radially outwardly with respect to the tubular support.

As will be explained, when the assembly is being lowered into the well, the expander 30 will be in the position shown in FIGS. 2 and 7, and its lower portion will not be behind the locking keys or dogs 34. At such time, the spring 36 would be urging the locking dogs 34 outwardly and until such time as the dogs move opposite the locking recesses 22, the peripheral surfaces of the dogs will be riding the interior wall of the well conductor or tubing. When the parts move to the position shown in FIG. 3, the lower end of the expander mandrel 30 will move behind the dogs to lock the dogs into firm engagement with the locking recesses 22. Obviously, when the dogs are engaged in the recesses, the axial displacement of the assembly will be prevented.

Figure 4:
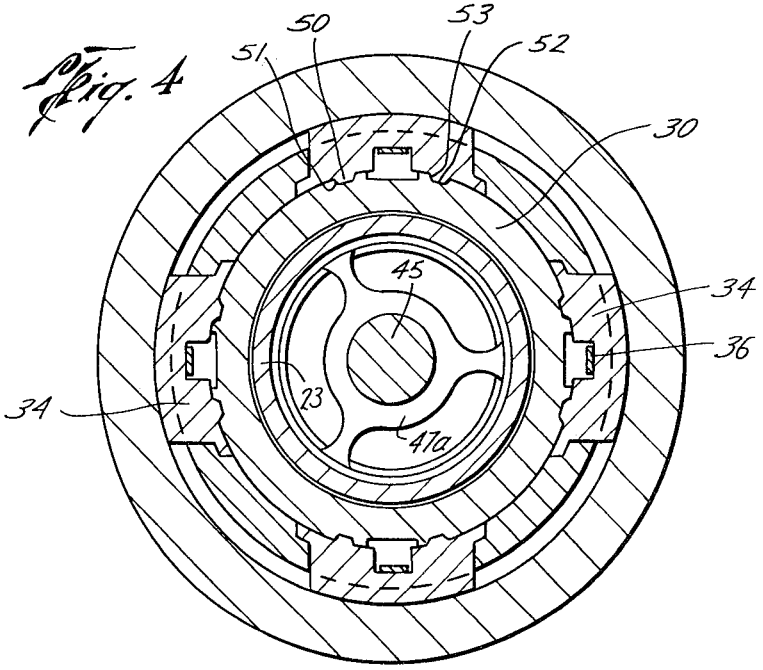
FIG. 4 is a view in section along the lines 4—4 of FIG. 3A.

For preventing any rotative force to be applied to the dogs after the motor and pump are started in operation, the lower portion of the expander mandrel is formed with longitudinal grooves 52 (FIG. 4), which, as will be explained, are adapted to receive cam means such as ribs 50 formed on the internal surface of each locking key. Obviously, rollers held in place by suitable springs or elastomers may be used as cam means. The details of the cam ribs 50 which have inclined sides 51 and the groove 52 which has inclined side surfaces 53 will be hereinafter explained in connection with the operation of the assembly. Suffice it to say that any rotative force which is applied to the expander 30 will be transmitted through surfaces 53 and 51 to each locking dog, and by reason of the structure, these forces are converted into a radial force which will urge each locking dog in a radial direction and into very tight frictional contact with its respective groove. Therefore, if there be any rotative force applied to the expander by reason of the inertia torque applied as the motor shaft operates, the dogs or keys 34 will not be displaced but will be moved into tighter frictional contact with their respective grooves.

Connected to the lower end of the outer sleeve or body 31 is a packing assembly which includes a main tubular body 38 having suitable packing members 39 mounted on its exterior and adapted to seal with the bore 21*a* of the landing nipple 19. An equalizing passage 40 is formed in the lower portion of the packing assembly body 38 and its upper end 41 communicates with the bore of the inner tubular support when such support is in a raised position with respect to the packing assembly. When the inner tubular support is in a lowered position relative to the outer housing 31 and the packing assembly secured to the lower end of said housing, the passage 40 is sealed by a pair of O-rings 42 mounted on the outer surface of the tubular support member. To frictionally maintain the inner tubular support in a lowered position with respect to the outer housing, the packing assembly body 38 has an internal groove 38*a* adapted to be engaged by a detent ring 43 carried within the groove of the inner tubular support. The detent ring 43 has its upper and lower surfaces inclined so that it may be disengaged from groove 38*a* upon a predetermined pull.

The lower end of the packing assembly 38 is connected through a suitable coupling 44 with the pump housing, a portion of which is shown in FIG. 2. Extending axially within the locking assembly is a drive shaft 45 having splines 46 at its upper end for connection through the usual coupling with the motor shaft thereabove. Similar splines 46*a* are provided at the lower end of the shaft and provide for a connection with the pump. Alignment of shaft 45 which will transmit rotation from the motor to the pump is provided by suitable bearing sleeves 47 and 47*a* located within brackets on the discharge head 15 and the lower packing assembly 38, respectively.

Figure 7:
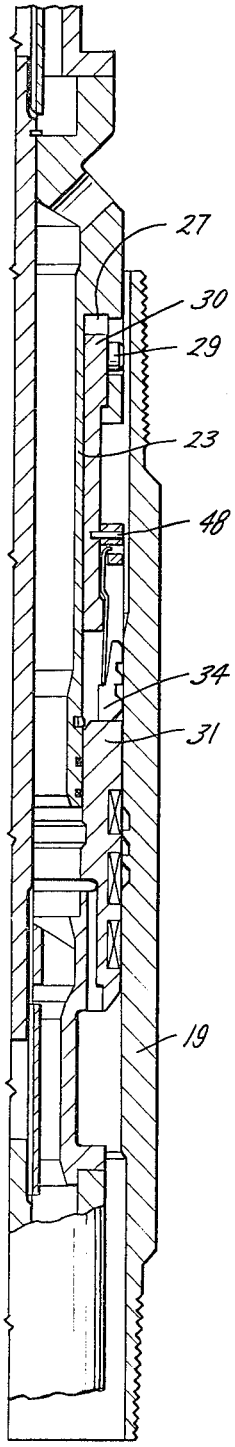
FIGS. 7, 8, 9 and 10 are quarter-section views showing successively the assembly being run in the tubing, set in the tubing, pressure equalized for pulling, and being pulled from the tubing.

The operation of the locking assembly is illustrated in the schematic sections in FIGS. 7 through 10. When the assembly is to be run into the well, the parts are in the position shown in FIG. 7 and at this time, the expander mandrel 30 is connected to the upper end of the outer housing 24 through shear pins 48. In this position, the expander mandrel is elevated with respect to the locking keys 34 which are spring loaded outwardly against the tubing well by spring 36 and said mandrel is in a lowered position with respect to the inner tubular support 23. The tubular support is in a raised position with respect to the outer sleeve or housing 31 as well as with respect to the packing assembly 38. This position of the parts is illustrated in FIG. 7 and the equipment, together with the locking assembly is lowered downwardly into the well tubing 10 with the locking keys riding the wall of the tubing.

When the locking keys move opposite to the annular recesses 22, which are formed within the landing nipple 19, the spring of each locking key urges it outwardly into engagement with the locking recesses. The weight of the assembly which includes the pump, motor protector and associated parts, is then placed on the shear pins 48 and said pins are sheared to permit the parts to move to the position shown in FIG. 8. In this position, the inner support 23 moves downwardly to close the passage 41 in the packing assembly by moving the O-rings 42 on either side thereof and causes the detent ring 43 which is carried by the tubular support to snap into the groove 38*a* provided in the bore of the packer assembly. At the same time that the expander mandrel is moved to the position of FIG. 8 its lower portion moves behind each of the locking keys 34 so that said keys cannot be retracted from their respective locking recesses. In this set position of the parts, any axial displacement of the equipment is prevented.

For preventing any rotation of the keys within their respective annular recesses, the inwardly extending cam rib 50 (FIG. 4) of each key has its inclined faces 51 projecting into the vertical or longitudinal recesses 52 which are formed on the outer face of the annular expander mandrel 30. Since the sides of each groove are inclined as indicated at 53, such inclined surfaces engage and coact with the inclined surfaces 51 of the cam ribs to urge the locking keys outwardly.

Figure 8:
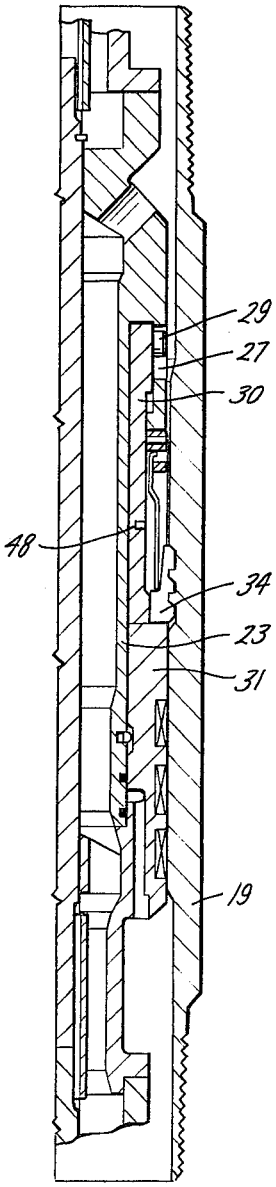

When the parts are in the position of FIG. 8, which is the set position, the motor will be started to operate the pump. At such start-up, there is an inertia torque which builds up and which can be transmitted through the motor housing and then through the inner tubular support to the expander mandrel. This torque might apply a rotative movement to the various parts, but by reason of the cam ribs and the cam grooves, any torque applied to the expander mandrel in a circumferential direction will be immediately transmitted to the cam ribs. Because of the inclined engaged surfaces 51, 53, this torque will convert to a radial force which will urge each locking key into a tight frictional contact with the annular recesses. Thus, the arrangement of the cam ribs and coacting cam grooves convert a rotative force into a radial force and function as an anti-rotative device which assures that the locking keys will be maintained in firm frictional engagement with the walls of the locking recesses.

Figure 9:
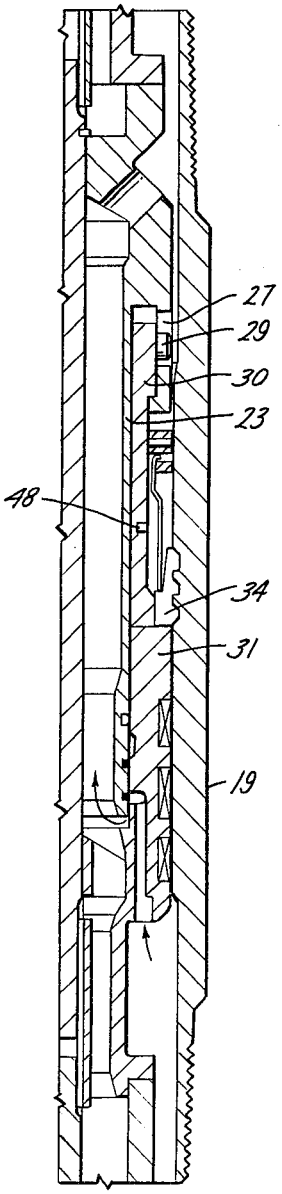
Figure 10:
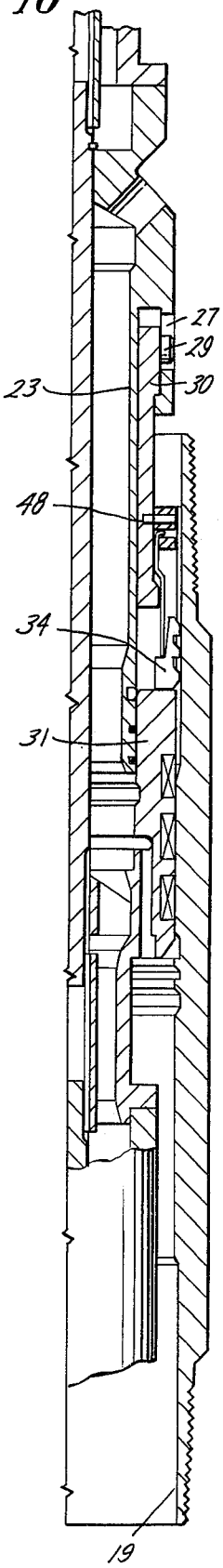

When it is desired to remove the pumping equipment from the well, it is only necessary to lift the cable to thereby move the inner tubular support upwardly to the position shown in FIG. 9. By reason of the pin and slot connection 27, 29, the lower end of the inner tubular support will move upwardly with respect to the main body 38 of the locking assembly to thereby move the lower end of support 23 above the equalizing port 40 and all pressure will be equalized around the particular equipment. It is noted that the equalization of pressures occurs before the expander mandrel is lifted from behind the locking keys so that release of the keys from their recesses is easily accomplished. Following the equalization of pressures, continued upward movement results in the parts moving to the position shown in FIG. 10 which removes the expander mandrel from behind the locking keys, thereby allowing said keys to retract from their respective recesses.

The foregoing disclosure and description of the invention is illustrative and explanatory thereof and various changes in the size, shape and materials, as well as in the details of the illustrated construction may be made within the scope of the appended claims without departing from the spirit of the invention.

What is claimed is:

1. A locking assembly for locking equipment having a rotating element within a well bore including a motor housing having the rotating element extending therethrough, a tubular support having its upper end connected with said housing, an outer tubular body encircling a portion of said support, a plurality of locking keys mounted in said body and movable radially into a locking position within a well fluid conductor extending through said well bore, an expander member interposable between the tubular support and the locking keys and movable relative to said keys from a first position in which the keys are unlocked to a second position where the keys are locked, means connecting said expander member to the motor housing having the rotating element of said equipment extending therethrough whereby the torque forces developed by said rotating element are transmitted to the expander member and apply a rotative force thereto, and coacting means between said expander member and said locking keys for converting the rotative force applied to the expander member into a radial force acting upon the locking keys to urge said keys into tighter locking position.

2. A locking assembly as set forth in claim 1, wherein said rotating element comprises a rotating shaft of an electric motor, and said equipment includes a pumping unit having connection with said shaft for pumping well fluids from the well.

3. A locking assembly as set forth in claim 1, together with a landing nipple connected in the well fluid conductor and having locking recesses within its bore, and each locking key having on its exterior surface locking lugs adapted to engage the locking recesses of said nipple when said key is moved radially outwardly.

4. A locking assembly as set forth in claim 1, together with a landing nipple connected in the well fluid conductor and having locking recesses within its bore, each locking key having on its exterior surface locking lugs adapted to engage the locking recesses of said nipple when said key is moved radially outwardly, and means on the expander member for engaging the locking keys to maintain said keys in their radially outward position and thereby hold said keys engaged with said lock recesses.

5. A locking assembly as set forth in claim 1, together with an equalizing valve at the lower end of the tubular support and the outer body and constructed so as to be opened and closed by the relative movement of the support with respect to the body, said equalizing valve being closed when the locking keys are in a locked position and being moved to an open position to equalize pressures around the assembly prior to the time that the locking keys move into an unlocked position.

6. A locking assembly as set forth in claim 1, wherein the coacting means between the expander member and said locking means for converting the rotative force into a radial force comprises inwardly extending projections on each locking key with each projection having inclined surfaces, and also wherein the expander member is provided with complementary grooves for coacting with said projections so that any rotative force applied to said expander member is transmitted to each of the locking keys to urge them into tighter gripping position.

7. A locking assembly for locking pumping equipment including a motor, motor housing and rotating shaft within a well conductor comprising a tubular landing nipple connected in said well conductor and having annular locking recesses within its bore, a tubular support having its upper end connected with the motor housing, an outer body circulating a portion of said mandrel and having its bore spaced from the exterior of the mandrel, at least one locking key mounted for radial movement in said body, each locking key having external projections adapted to engage the locking recesses within the bore of the landing nipple to lock said body within the landing nipple, a tubular expander mandrel surrounding the support and movable within a portion of the bore of the outer body to a position behind the locking keys to maintain said keys engaged with the locking recesses, means connecting the expander mandrel to the motor housing through the tubular support whereby the torque forces developed by the rotating shaft of the motor are transmitted through the motor housing and support to said expander mandrel to apply a rotative force thereto, and coacting means between said expander mandrel and said locking keys for converting the torque forces applied to the expander mandrel into radial forces acting upon the locking keys to urge said keys into tighter radial contact with the recesses of the tubular landing nipple.

8. A locking assembly for locking pumping equipment as set forth in claim 7, together with frangible means connecting the tubular expander mandrel to the tubular support in a position spaced from the locking keys whereby the assembly may be lowered within the well conductor.

9. A locking assembly for locking pumping equipment as set forth in claim 7, together with frangible means connecting the tubular expander mandrel to the tubular support in a position spaced from the locking keys whereby the assembly may be lowered within the well conductor, and resilient means for urging the locking keys outwardly whereby when said keys are opposite the locking recesses, said locking keys are urged outwardly into engagement with the locking recesses.

10. A locking assembly for locking pumping equipment as set forth in claim 7, together with frangible means connecting the tubular expander mandrel to the tubular support in a position spaced from the locking keys whereby the assembly may be lowered within the well conductor, resilient means for urging the locking keys outwardly whereby when said keys are opposite the locking recesses, said locking keys are urged outwardly into engagement with the locking recesses, and detent means releasably latching said expander mandrel in a position behind the locking keys.

11. A locking assembly as set forth in claim 7, together with means for equalizing pressures around the assembly when it is desired to remove said assembly from the well, said equalizing means being closed when the locking keys are in a locking position and being opened prior to the time that said keys move to an unlocked position.

12. A locking assembly as set forth in claim 7, wherein the configuration of the annular locking recesses within the bore of the tubular landing nipple is preselected, and wherein the projections on each locking key have a mating configuration with the locking recesses.

13. A locking assembly as set forth in claim 7, wherein the coacting means between the expander mandrel and said locking means for converting the rotative force into a radial force comprises inwardly extending projections on each locking key with each projection having inclined surfaces, and also wherein the expander mandrel is provided with complementary grooves for coacting with said projections so that any rotative force applied to said expander member is transmitted to each of the locking keys to urge them into tighter gripping position.

* * * * *